US005884435A

United States Patent [19]

David et al.

[11] Patent Number: 5,884,435

[45] Date of Patent: Mar. 23, 1999

[54] STEPPED FLASHING FOR SIDING PANELS

[75] Inventors: Denis W. David; James A. Turner, both of Snohomish, Wash.

[73] Assignee: JDt LLC, Redmond, Wash.

[21] Appl. No.: 792,275

[22] Filed: Jan. 31, 1997

[51] Int. Cl.[6] ..... E04D 1/36

[52] U.S. Cl. ..... 52/62; 52/58; 52/302.6

[58] Field of Search ..... 52/58, 60, 61, 52/62, 287.1, 302.6

[56] References Cited

U.S. PATENT DOCUMENTS

| | | | |
|---|---|---|---|
| 2,043,049 | 6/1936 | Ludden | 52/62 |
| 2,154,734 | 4/1939 | Doing | 52/302.6 |
| 2,226,886 | 12/1940 | Willis | 52/62 |
| 2,245,965 | 6/1941 | Cunin | 52/302.6 X |
| 2,699,058 | 1/1955 | Ehrenberg | 52/302.6 |
| 2,787,156 | 4/1957 | Goodwin | 52/62 X |
| 3,981,108 | 9/1976 | Berg | 52/62 X |
| 4,485,600 | 12/1984 | Olson | 52/62 |
| 4,700,512 | 10/1987 | Laska | 52/62 X |
| 5,056,277 | 10/1991 | Wilson | 52/62 |
| 5,109,641 | 5/1992 | Halan | 52/62 |
| 5,349,792 | 9/1994 | Bayes | 52/62 |

*Primary Examiner*—Christopher Kent
*Assistant Examiner*—Timothy B. Kang
*Attorney, Agent, or Firm*—Graybeal Jackson Haley LLP

[57] ABSTRACT

The invention relates to a flashing for use with siding panels possessing an interior and an exterior surface, and a perimeter surface having a predetermined sectional width, and includes a first, a second, and a third portion, and a first and a second non-perforated, generally planar transition portion, each portion having an interior and an exterior surface wherein (a) the portion continues to the first generally planar transition portion and forms a first angle there between; wherein (b) the first generally planar transition portion continues to the second portion and forms a second angle there between; wherein (c) the second portion continues to the second generally planar transition portion and forms a third angle there between; and wherein (d) the second generally planar transition portion continues to the third portion, which is substantially parallel to the first portion, and forms a fourth angle there between. The angle between the various portions can be modified to facilitate water migration away from a siding panel placed in contact therewith, and the transverse distance of the transition portions can be varied, preferably to approximately 50% of the siding sectional width.

5 Claims, 4 Drawing Sheets

STEPPED FLASHING FOR SIDING PANELS

BACKGROUND

Housing and building exteriors are naturally subjected to environmental conditions that are destructive to the materials used to construct the exteriors. In particular, when natural materials are used, such as wood, rot and decay are the most common modes of exterior failure. Improperly situated siding materials cannot properly shield the interior surfaces to which they are attached, and are themselves subject to premature destruction, usually through invasion of moisture.

A common means for establishing housing and building exteriors is to use wood siding materials such as shingles in lap configuration. In view of the diminishing availability of certain siding materials, oriented strand board (OSB) siding has become pervasive in many parts of the world. Through the use of OSB materials, a structurally rated siding can be used, thereby eliminating conventional sheathing materials such as plywood sheathing. Moreover, conventional moisture barriers such as building paper are dispensed with since the OSB also acts as a moisture barrier.

It therefore becomes of paramount importance to establish a sound moisture barrier when using OSB siding. The predominant point of failure when using OSB occurs at the juncture between OSB panels. As shown in Prior Art FIG. 1, the abutting edges of two OSB panels 1 and 2 are separated by flashing 3. As is shown in more detail in Prior Art FIG. 2, this common flashing is characterized as having a first portion 4 and a second portion 6 connected by a transverse portion 5. The intended purpose of this flashing is to prevent water drip back from the bottom edge of panel 1 to the interior, and to provide a drip cap for panel 2. A common problem with this configuration, however, is that water tends to collect on the upper surface of transverse portion 5. Because in normal installations the upper surface is in direct contact with the lower edge of panel 1, rot and decay are in fact promoted as opposed to retarded.

A possible but labor intensive solution to this problem is to carefully space panel 1 from transverse portion 5. But given that each panel may weigh as much as 20 kilograms (50 pounds), such actions may be difficult if not impossible to achieve in an aesthetically pleasing manner.

Therefore, what is needed is a flashing that not only provides the desired water barrier between the environment and the interior surfaces to which the panels are attached, but also a means to prevent water accumulation at the lower edge of each panel. The present invention is intended to meet these needs.

SUMMARY OF THE INVENTION

The present invention is directed to an improved flashing for use in conjunction with siding panels having an exterior surface and interior surface, and a perimeter surface. The configuration of the flashing provides for desirable panel support as well as enhanced rot and decay prevention at adjacent panel edges. The flashing comprises a first generally planar vertical portion having an interior and exterior surface, a first generally planar extending portion having an interior and exterior surface, a second generally planar vertical portion having an interior and exterior surface connecting the first generally planar extending portion to a second generally planar extending portion having an interior and exterior surface, and a third generally planar vertical portion having an interior and exterior surface connected to the second generally planar extending portion. Thus, in section, the flashing approximates a two tread/three riser stair configuration.

In use, the first generally planar vertical portion is located between the interior surface of a panel and the structure to which the panel is to be anchored so that the exterior surface of the first vertical portion is in contact with the interior surface of the panel. The exterior surface of the first generally planar extending portion is brought adjacent to, and preferably in contact with, the panel's lower perimeter surface. The degree of sectional width of the first extending portion is dependent upon the perimeter width of the panel, and is at all times less than the perimeter width so that a portion of the panel perimeter is not adjacent to, nor in contact with, the exterior surface of the first extending portion. In a preferred embodiment, the degree of sectional width of the first extending portion is less than 50% of the sectional width of the panel's lower perimeter width. The result is that more than 50% of the panel's lower perimeter surface is exposed to the environment.

A preferred embodiment utilizes a second panel, similar to the first panel, located so that an upper perimeter edge thereof is brought adjacent to, and preferably in contact with, the interior surface of the second generally planar extending portion of the flashing. The third vertical portion extends over a portion of the upper exterior surface of the second panel, thus, in combination with the second extending portion, forms a drip cap therefor. The resulting configuration of the preferred two panel embodiment provides vertical support for the first panel while not contacting the entire lower perimeter surface of the first panel, and provides appropriate shielding for the exposed portion of the upper perimeter surface of the second panel.

While the basic invention has been described, alternative embodiments of the invention include use in conjunction with belly bands, and as window and door flashings, horizontal drip cap flashings, water sills, column caps, starter strips and alignment strips. Moreover, the invention can be used as securing clips for facia and belt boards. These and other features of the invention will become apparent by reviewing the following description and related drawings.

DETAILED DESCRIPTION OF THE INVENTION

Figure 1:
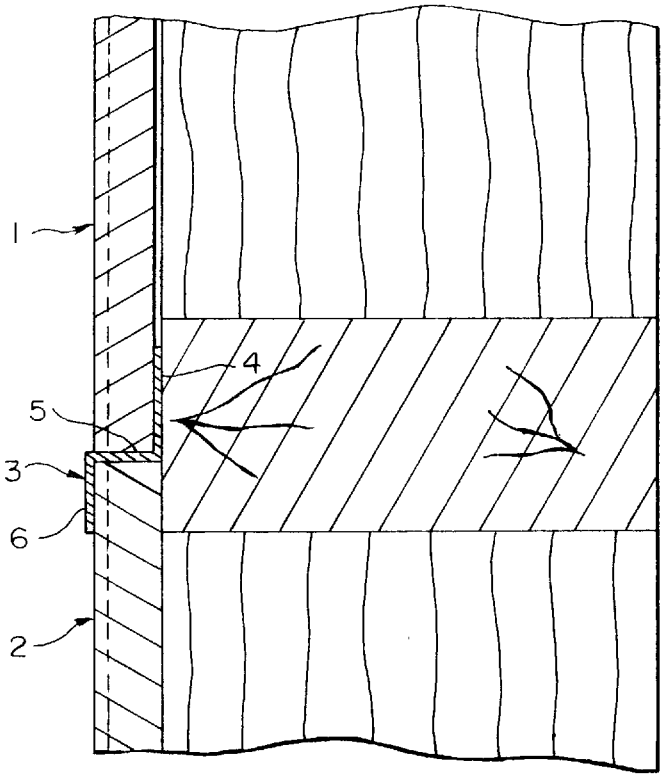
FIG. 1 PRIOR ART
FIG. 1 is a side elevation view, in section, of a prior art flashing when used in conjunction with two planar siding panels.
Figure 2:
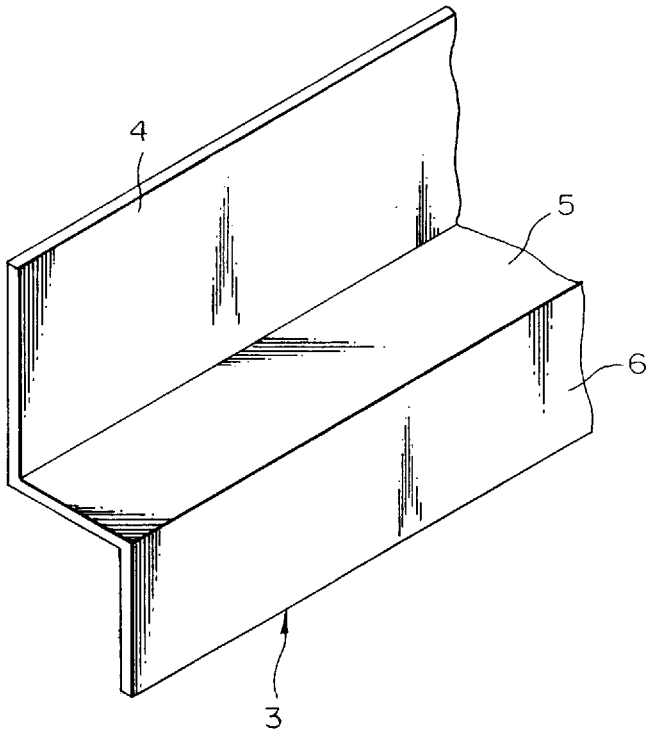
FIG. 2 PRIOR ART
FIG. 2 is a perspective view of a prior art flashing.
Figure 3:
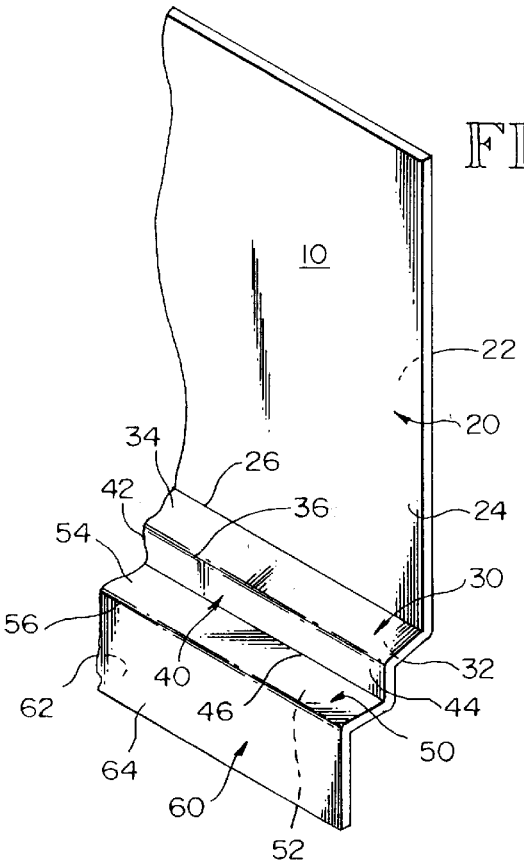
FIG. 3 is a perspective view of the present invention showing the general structural configuration thereof.

Referring to the several figures wherein like numerals indicated like parts, and first to FIG. 3, a perspective view of the invention is shown. Flashing 10 can be constructed from any pliable and durable material such as metal or plastic. If constructed from metal, the configurations shown herein can be achieved through brake or roll forming, although brake forming is preferred. It is to be understood that the metal chosen for forming must be capable of undergoing plastic deformation so that the resulting geometry is retained over time. If flashing 10 is to be constructed from plastic, extrusion forming is preferable when using thermoplastic stock, and lay-up or impregnation forming is preferable when using thermosetting stock.

Flashing 10 has first generally planar vertical portion 20 which includes interior surface 22 and exterior surface 24. Extending from edge portion 26 is first generally planar extending portion 30 which includes interior surface 32 and exterior surface 34. Depending from edge portion 36 is second generally planar vertical portion 40 which includes interior surface 42 and exterior surface 44. Extending from edge portion 46 is second generally planar extending portion 50 which includes interior surface 52 and exterior surface 54. Finally, depending from edge portion 56 is third generally planar vertical portion 60 which includes interior surface 62 and exterior surface 64. Thus, as is shown in FIG. 3, flashing 10 approximates a two tread/three riser stair configuration.

Figure 4:
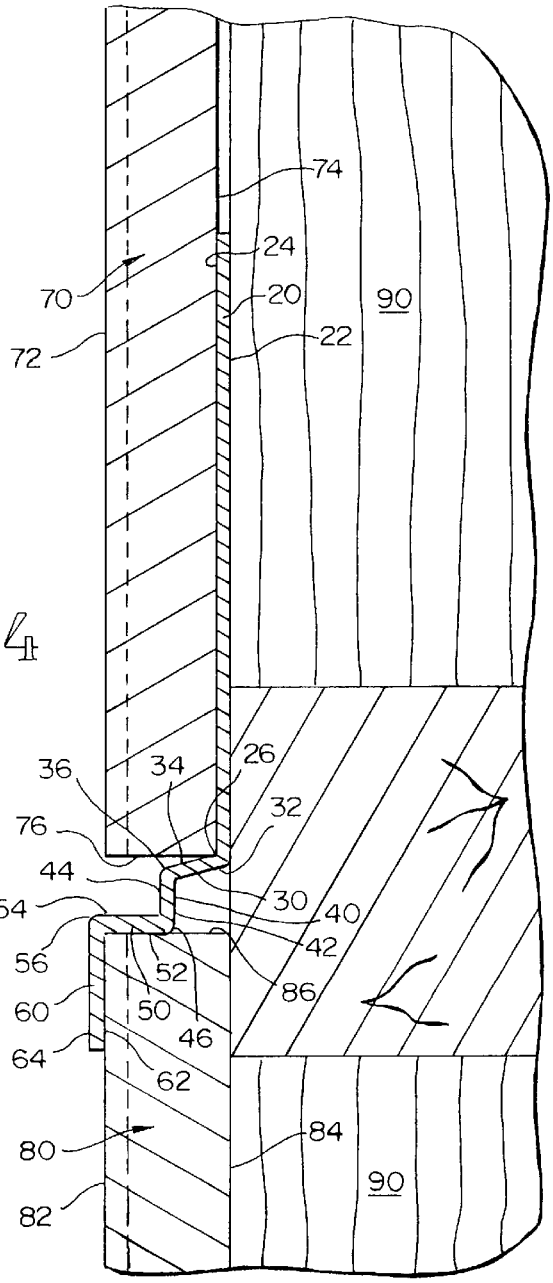
FIG. 4 is a side elevation view, in section, of the invention when used in conjunction with two planar siding panels, emphasizing the nature of its contact with an upper siding panel.

Turning to FIG. 4, flashing 10 is shown in conjunction with siding panels 70 and 80. Side panel 70 has exterior surface 72, interior surface 74, and lower perimeter surface 76; side panel 80 has exterior surface 82, interior surface 84, and upper perimeter surface 86. As shown, interior surface 22 of vertical portion 20 is located adjacent to framing member 90, and exterior surface 24 of vertical portion 20 is located adjacent to interior surface 74 of panel 70 so that edge 26 is brought into contact with lower perimeter surface 76. If the angle between vertical portion 20 and first extending portion 30 is approximately 90°, then there will exist substantial contact between exterior surface 34 of extending portion 30 and lower perimeter surface 76. As shown in this figure with a preferred embodiment, however, the angle approximates 105°, thus creating a slight down slope. Consequently, only a small portion of perimeter surface 76 contacts exterior surface 34 of first extending portion 30 near edge portion 26. This configuration beneficially urges water away from the interior portions of the panel towards edge 36.

Side panel 80 is similarly located adjacent to framing member 90 so that interior surface 52 of second extending portion 50 is located adjacent to upper perimeter surface 86 of second panel 80. As shown, second extending portion 50 is of sufficient width so that third vertical portion 60 extends over a portion of exterior surface 82 of panel 80. In so doing, a drip cap is formed, thereby protecting upper perimeter surface 86 of second panel 80 from direct moisture and other environmental elements. The inside angle between second extending portion 50 and third vertical portion 60 will usually be between about 90° to 105° and is shown in this Fig. as being about 90°.

From the foregoing it can be seen that the ultimate widths of the various portions of flashing 10 are largely dependent upon the width of the panels chosen for any installation. A feature of the present invention is to have first extending portion 30 extend less than 50% of the sectional width of the panels used in the installation. By establishing a less than 50% contact area, it remains possible to apply weatherproofing agents to lower perimeter surface 76, yet still provide sufficient support and shielding to panel 70. Moreover, when using grooved or channeled OSB panels, the depth of the grooves or channels is tightly controlled relative to the sectional width of the panel, and never exceeds 50% of the panel's sectional width.

Figure 6:
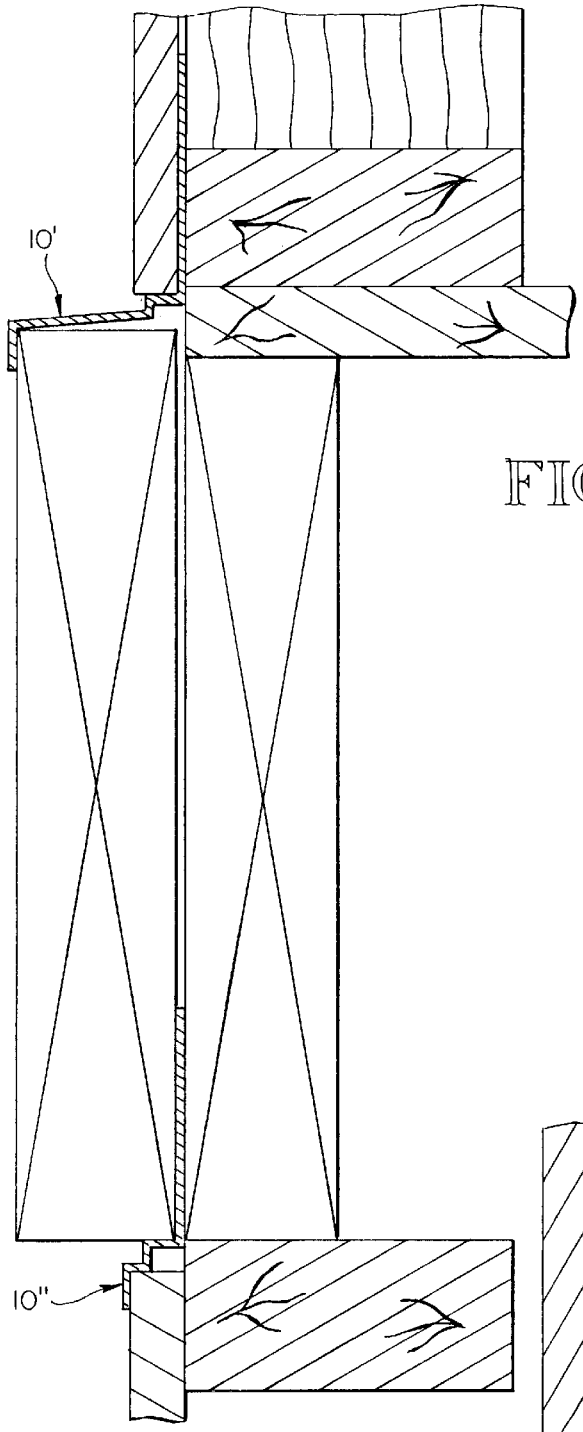
FIG. 6 is a side elevation view, in section, of the invention when used in conjunction with a siding panel and another structure wherein the exterior surface of the structure is not planar with the exterior surface of the siding panel.
Figure 5:
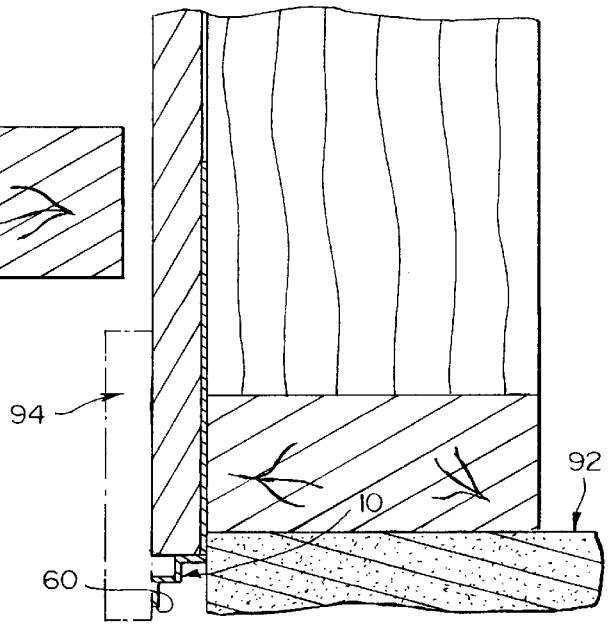
FIG. 5 is a side elevation view, in section, of the invention when used in conjunction with a single siding panel illustrating use of the invention as a facia or belt attachment point.

The present invention has further utility as shown in FIGS. 5 and 6. As shown in FIG. 5, flashing 10 acts as a skirt to protect panel 70 as previously described, and to redirect migrating water away from foundation 92. If a belt or facia board is desired at the lower portion of panel 70, third vertical portion 60 provides for a structurally sound attachment point therefor. Such an accessory is shown in phantom as belt 94.

In FIG. 6, flashing 10' illustrates an installation wherein a wide second extending portion 50' is employed. Flashing 10" is generally similar to the embodiment shown in FIGS. 1–4.

Figure 7:
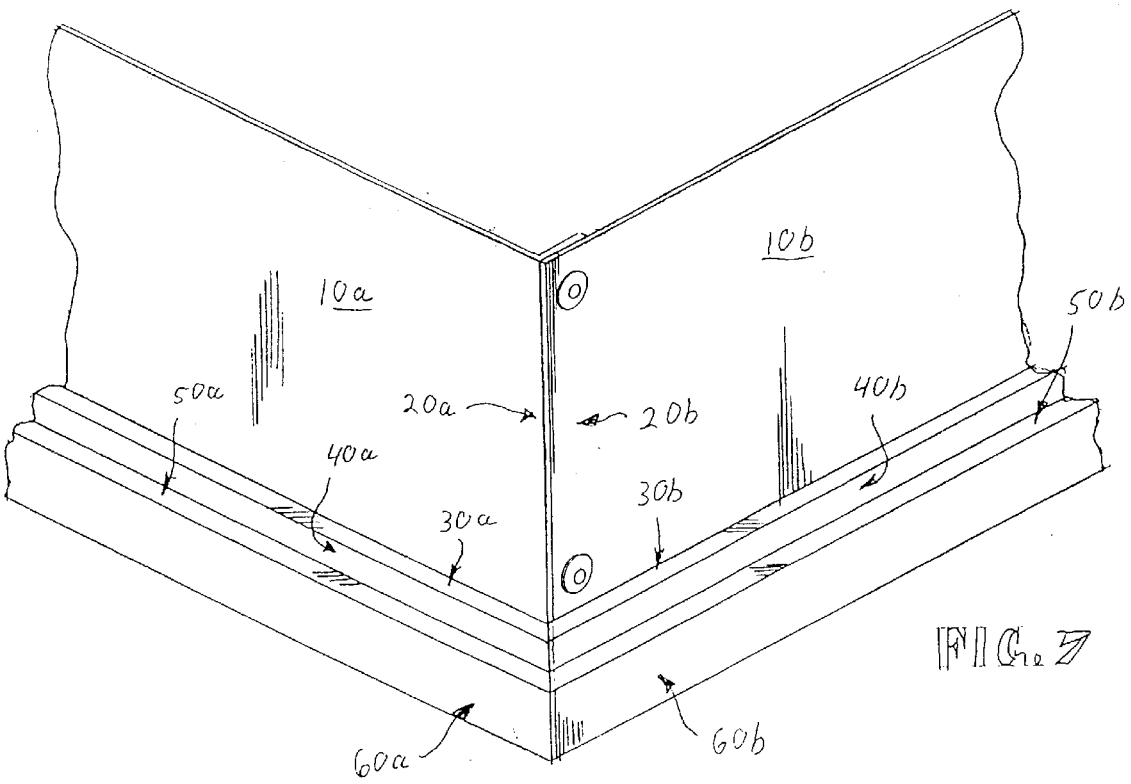
FIG. 7 is an exterior perspective view of an outside corner embodiment of the invention.
Figure 8:
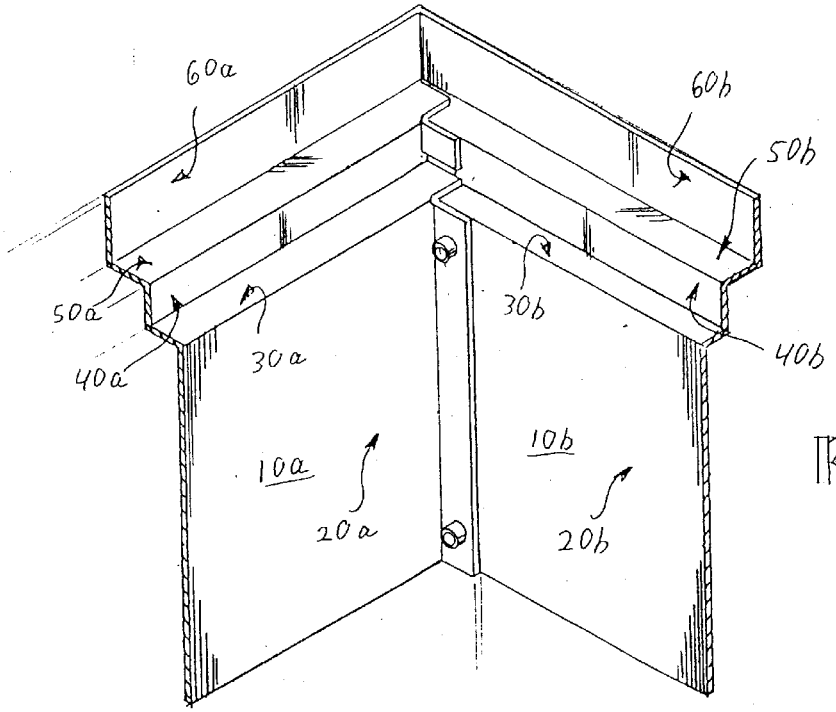
FIG. 8 is an interior perspective view of the outside corner embodiment of FIG. 7.

The embodiment shown in FIGS. 7 and 8 illustrates use of the invention in corner installations. As shown, each portion of flashing **10*a* is congruent with each portion of flashing 10*b*. When exterior angles are desired, as is shown, third vertical portions 60*a* and 60*b* are seamless, i.e. the surface is contiguous. Such a configuration provides for a smooth surface, free of seams, and in particular suitable for use in applications wherein this portion of the flashing is exposed. Because of the complex angles of the remaining portions of the flashing, it is not possible to create a seamless joint at the juncture between first vertical portions 20*a* and 20*b*, first extending portions 30*a* and 30*b*, second vertical portions 40*a* and 40*b*, or second extending portions 50*a* and 50*b*** when using sheet metal material and brake forming methods. However, it is possible to form seamless junctures if alternate materials and forming methods are used such as stamping of sheet metal.

From the foregoing examples it should be apparent that numerous possible permutations of the basic invention are possible and are intended to be within the scope of the invention.

What is claimed:

1. A flashing, a first, and a second siding panel combination wherein the first and second siding panels comprise an interior surface, an exterior surface, and a perimeter surface having a predetermined sectional width, the combination comprising:

a flashing comprising a first, a second, and a third portion, and a first and a second planar transition portion, each portion having an interior and an exterior surface wherein (a) the first portion continues to the first transition portion and forms a first angle there between; wherein (b) the first transition portion continues to the second portion and forms a second angle there between; wherein (c) the second portion continues to the second transition portion and forms a third angle there between; and wherein (d) the second transition portion continues to the third portion, which is substantially parallel to the first portion, and forms a fourth angle there between; and wherein the first siding panel is located adjacent to and is in contact with a portion of the first transition portion, and the second siding panel is located adjacent to and is in contact with a portion of the second transition portion.

2. The flashing and siding panel combination of claim 1 wherein the first angle is an interior angle and measures from about 90° to 105°.

3. The flashing and siding panel combination of claim 1 wherein the third angle is an interior angle and measures from about 90° to 105°.

4. The flashing and siding panel combination of claim 1 wherein the first angle is an interior angle and measures from about 90° to 105°, and the third angle is an interior angle and measures from about 90° to 105°.

5. The flashing and siding panel combination of claim 1 wherein the first generally planar transition portion continues a distance from the first portion less than 50% of the maximum sectional width of the perimeter surface of the first siding panel.

* * * * *